US012391423B2

(12) United States Patent
Wettenstein

(10) Patent No.: US 12,391,423 B2
(45) Date of Patent: Aug. 19, 2025

(54) BOTTLE SHAPED CONTAINER

(71) Applicant: EZPOUR BOTTLE LLC, Staten Island, NY (US)

(72) Inventor: Gabriel Wettenstein, Staten Island, NY (US)

( * ) Notice: Subject to any disclaimer, the term of this patent is extended or adjusted under 35 U.S.C. 154(b) by 811 days.

(21) Appl. No.: 16/703,326

(22) Filed: Dec. 4, 2019

(65) Prior Publication Data

US 2021/0047067 A1 Feb. 18, 2021

Related U.S. Application Data

(63) Continuation-in-part of application No. 29/702,166, filed on Aug. 16, 2019, now Pat. No. Des. 957,945.

(51) Int. Cl.

| | |
|---|---|
| ***B65D 1/02*** | (2006.01) |
| ***B65D 23/10*** | (2006.01) |
| ***B65D 47/08*** | (2006.01) |

(52) U.S. Cl.
CPC ..... *B65D 1/0223* (2013.01); *B65D 23/102* (2013.01); *B65D 47/0857* (2013.01)

(58) Field of Classification Search
CPC . B65D 1/0223; B65D 23/102; B65D 47/0857
USPC ..... 215/384, 379, 382
See application file for complete search history.

(56) References Cited

U.S. PATENT DOCUMENTS

| | | | | |
|---|---|---|---|---|
| D73,990 | S | * | 11/1927 | Young ..... 215/382 |
| 2,688,424 | A | | 9/1954 | Keiter |
| D233,216 | S | | 10/1974 | Cachero |
| D282,050 | S | | 1/1986 | Beaver et al. |
| D283,453 | S | | 4/1986 | Hurrell |
| 4,890,752 | A | | 1/1990 | Ota et al. |
| D314,142 | S | * | 1/1991 | Briggs ..... D9/550 |
| 5,330,054 | A | | 7/1994 | Brown |
| 5,337,924 | A | | 8/1994 | Dickie |
| D357,864 | S | | 5/1995 | Rusnock et al. |
| D363,026 | S | | 10/1995 | Sillince et al. |
| 5,927,533 | A | | 7/1999 | Payne et al. |
| D523,345 | S | | 6/2006 | Kamineni |
| D573,476 | S | | 7/2008 | Hopkins |

(Continued)

FOREIGN PATENT DOCUMENTS

| | | |
|---|---|---|
| FR | 2733962 | 11/1996 |
| IS | 73262-0001 | 4/2010 |
| WO | WO 03/037728 | 5/2003 |

OTHER PUBLICATIONS

Search Report and Written Opinion dated Apr. 8, 2020 issued in International Patent Application No. PCT/US20/13711.

(Continued)

*Primary Examiner* — Orlando E Aviles
*Assistant Examiner* — Sanjidul Islam
(74) *Attorney, Agent, or Firm* — Cozen O'Connor

(57) ABSTRACT

A bottle-shaped container including a neck portion, a body portion, a first recess having a first longitudinal length, and a second recess having a second longitudinal length. A center of the first longitudinal length is aligned with a center of the second longitudinal length. The recesses of the side walls together defining a side grip to allow a user to grasp the container. One side wall is for a thumb of the user, and the other side wall is for up to four fingers, which exclude the thumb, to grasp the bottle in the way that lends itself to the shape of the bottle.

18 Claims, 5 Drawing Sheets

(56) References Cited

U.S. PATENT DOCUMENTS

| | | | | |
|---|---|---|---|---|
| 7,458,478 | B2 | 12/2008 | Kamineni | |
| D631,360 | S | 1/2011 | van Westreenen | |
| 7,975,883 | B2 | 7/2011 | Laib et al. | |
| D697,804 | S | 1/2014 | Hanson | |
| D706,633 | S | 6/2014 | Reisig et al. | |
| D724,896 | S | 3/2015 | Williams | |
| D745,408 | S * | 12/2015 | Koop | D9/550 |
| D800,501 | S | 10/2017 | Rummel et al. | |
| D818,368 | S | 5/2018 | Hanan et al. | |
| D862,235 | S | 10/2019 | Sanghavi | |
| 2005/0040132 | A1 * | 2/2005 | Saito | B65D 1/0223 215/379 |
| 2005/0121409 | A1 * | 6/2005 | Penny | B65D 23/102 215/384 |
| 2009/0289028 | A1 | 11/2009 | Sasaki et al. | |
| 2014/0374427 | A1 | 12/2014 | Matsuo et al. | |
| 2015/0251796 | A1 | 9/2015 | Melrose et al. | |
| 2017/0015466 | A1 | 1/2017 | Yourist et al. | |
| 2017/0334628 | A1 * | 11/2017 | Bangi | B65D 1/46 |

OTHER PUBLICATIONS

Office Action dated Jan. 31, 2022 issued in related U.S. Appl. No. 29/702,166.

* cited by examiner

BOTTLE SHAPED CONTAINER

CROSS-REFERENCE TO RELATED APPLICATION

This application is a Continuation-In-Part of U.S. application Ser. No. 29/702,166 filed Aug. 16, 2019 the content of which is incorporated herein by reference.

BACKGROUND OF THE INVENTION

1. Field of the Invention

The embodiment herein generally relates to the field of bottles and more particularly to a bottle shaped container.

2. Description of the Prior Art

Bottles are Plastic, and/or glass bottle-shaped containers have been extremely common over the years in the beverage, condiment, and household products industry. Generally, these containers, which have included a variety of shapes and sizes have been blow molded from a biaxially oriented synthetic resin such as, for example, polyethylene terephthalate resin. Blow molding of plastics allow the containers to be easily formed with increased elasticity thereby producing a container which is durable, lightweight and inexpensive.

U.S. Pat. No. 4,890,752 to Ota et al. discloses one example of a biaxial-orientation blow-molded bottle-shaped container. The container is integrally molded with a neck at the top of a cylindrical body and includes a side grip formed by a pair of recesses which are rectangularly shaped and located on the rear portion of each side wall of the container. At the centers of the recesses are flat surface portions with a plurality of anti-slip strips formed axially in parallel at predetermined intervals on the front of the container.

Furthermore the side grip of the above plastic container allows the user to lift and handle the container. However, depending on the fill of the container and the characteristics of the user, the side grip may not always be comfortable and easy to use. This may cause a user to grasp the container in areas not adapted for gripping which could result in the user losing control and dropping of the container. It could also result in damage to the container in the grasped area. The contents of the container could thus be spilled or even worse the container could burst or break.

SUMMARY OF THE INVENTION

It is an object of one aspect of the present invention to provide a bottle shaped container that overcomes the above problems.

It is an object of one aspect of the present invention to provide a bottle shaped container having a grip configuration that makes grasping and gripping of the container easier.

In view of the foregoing, one aspect of the present invention describes a bottled shaped container comprising:

- a neck portion;
- a body portion;
- a first recess having a first longitudinal length, and
- a second recess having a second longitudinal length,
- wherein a center of the first longitudinal length is aligned with a center of the second longitudinal length.

In accordance with one aspect of the present invention, the bottle is formed of glass and/or plastic.

In accordance with one aspect of the present invention, the first recess and the second recess are symmetrically positioned in the body portion.

In accordance with one aspect of the present invention, the first longitudinal length is about half the second longitudinal length.

In accordance with one aspect of the present invention, the container comprising a pour spout aligned with the shorter recess.

In accordance with one aspect of the present invention, the bottle-shaped container comprises:

- a portion front wall;
- a back wall;
- side walls, each side wall of the portion having a recess, the recesses of the side walls together defining a side grip to allow a user to grasp the container from the side walls.

In accordance with one aspect of the present invention, the one side wall is for up to four fingers to grip and is double the size of the corresponding side wall, which is for the user's thumb, thus enabling to grasp the bottle in the specific way in which the shape of the bottle lends itself.

In accordance with one aspect of the present invention, each of the two recesses includes a portion extending toward a center of the container, one recess is half the size of the other recess.

In accordance with one aspect of the present invention, the recesses of the side walls are positioned opposite from each other.

In accordance with one aspect of the present invention, the recesses of the side walls are symmetrically positioned.

In accordance with one aspect of the present invention, second recess is half the size of the first recess, although other sizes are conceivable such as one third, one quarter, or the like.

In accordance with one aspect of the present invention, the bottle has an extending portion having two side walls, each side wall of the portion having different-sized recesses, the recesses of the side walls together defining a side grip to allow a user to grasp the container by the side walls with fingers that correspond to the recesses.

One aspect of the present invention is a container having a grip configuration that makes grasping and gripping of the container easier to use, which reduces spillage.

In accordance with one aspect of the present invention, the bottle has a portion extending having two side walls, each side wall of the portion extending having two side walls, each side wall of the portion having different-sized recesses.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION OF THE PRESENTLY PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted to not unnecessarily obscure the embodiments herein. The examples used here are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein achieve this by providing a bottle-shaped container.

Figure 1:
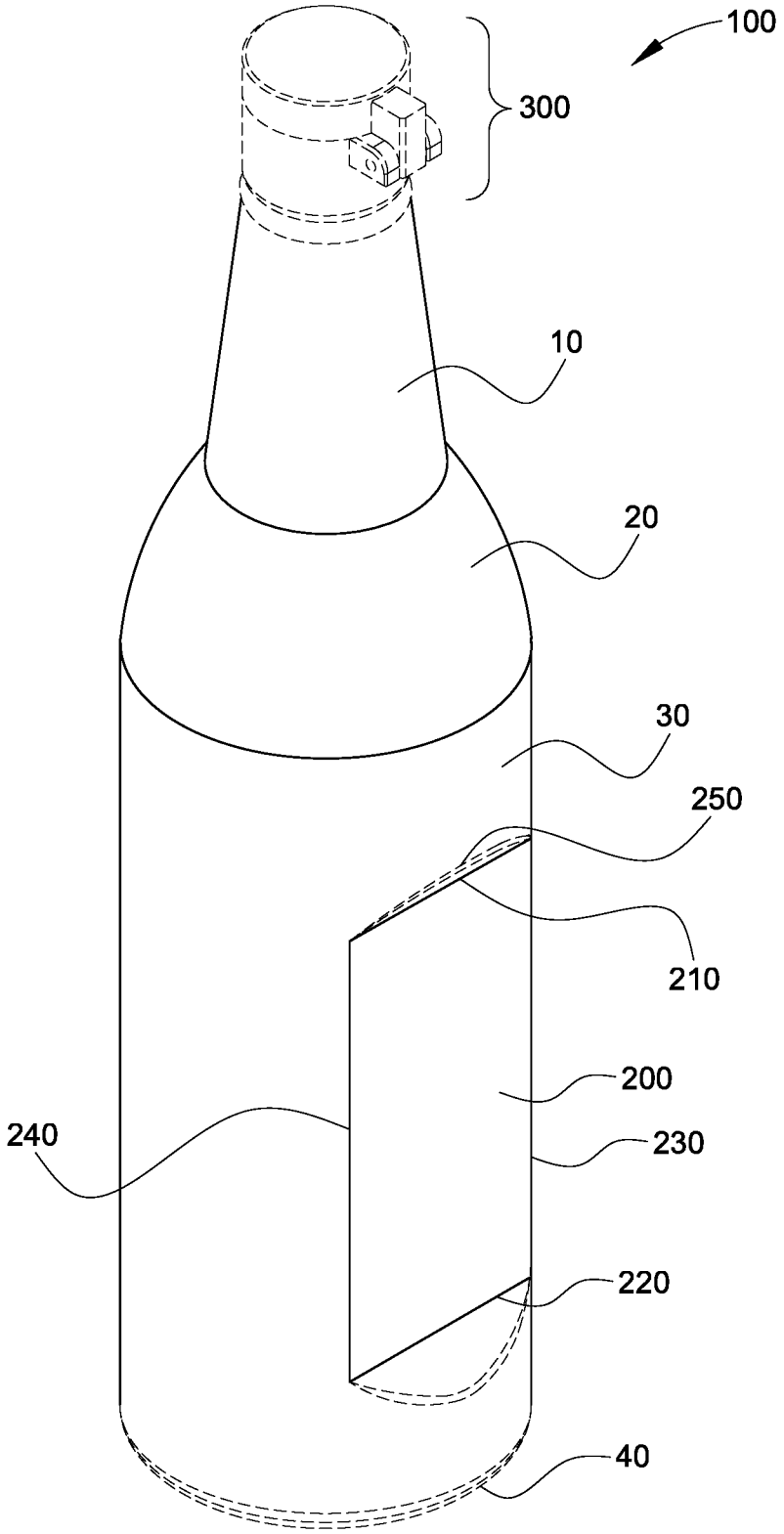
FIG. 1 is a frontal perspective view of a bottle-shaped container.

FIG. 1 illustrates a frontal perspective view of a bottle-shaped container 100. The bottle shaped container comprises a neck 10, a transition 20, a body 30, and a base 40. While shown in a specific configuration, the bottle-shaped container 100 can be configured in multiple different shapes. Indents or recesses for gripping the bottle-shaped container 100 are provided in each configuration of the bottle 100.

The bottle-shaped container 100 is sealed with a cap 300. The cap 300 is a flip-top cap. However, the cap 300 can be, but is not limited to, a screw cap, a snap-on cap, and crown cap, or the like.

The base 40 of the bottle-shaped container 100 is configured for the bottle to rest on. While the base 40 is generally planar, other configurations are possible. The base 40 may include a central punt, although such a punt is not necessary.

The cap 300 is attached to a neck 10, which is generally tapered in the longitudinal direction of the bottle-shaped container 100. A transition area 20 has a greater taper than the neck 10. The neck 10 and transition 20 are provided so that the diameter of the body 30 is tapered to the cap 300. The neck 10 and transition 20 may have a constant taper or a variable taper. It should be noted that the bottle-shaped container 100 can be can or drum shaped as well.

In one aspect of the present invention, the body 30 is generally circular. The term wall generally defines a 90° section of the circular body 30. The body 30 includes a recess 200. The recess 200 is radially inside an overall circumference of the body 30. The recess 200, while shown interrupting the outer surface of the bottle-shaped container 100, an inner surface of the body 30 may or may not have a corresponding shape. The recess 200 is substantially rectangular, bounded by linear features 210, 220, 230, and 240. The linear features form a rectangular recess, however, other shapes are conceivable including circles, ovals, and other polygons. In the longitudinal direction, the lead-ins 250, 260 to the recess 200 are preferably sloped. While the lead-ins can be substantially perpendicular to a surface of the recess 200, the sloped lead-ins provide easier manufacture.

Figure 2:
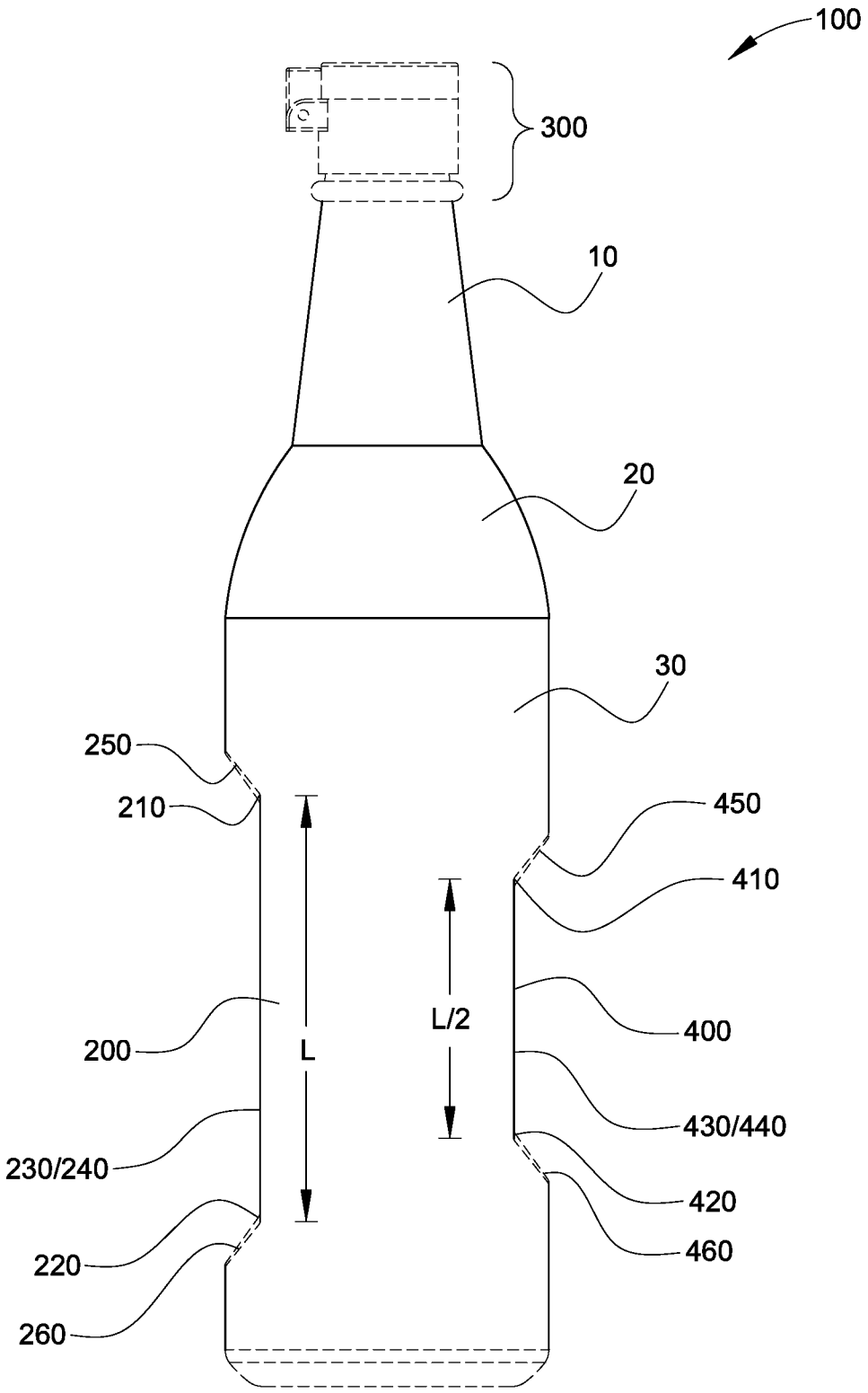
FIG. 2 is a side view of the bottle-shaped container.
Figure 4:
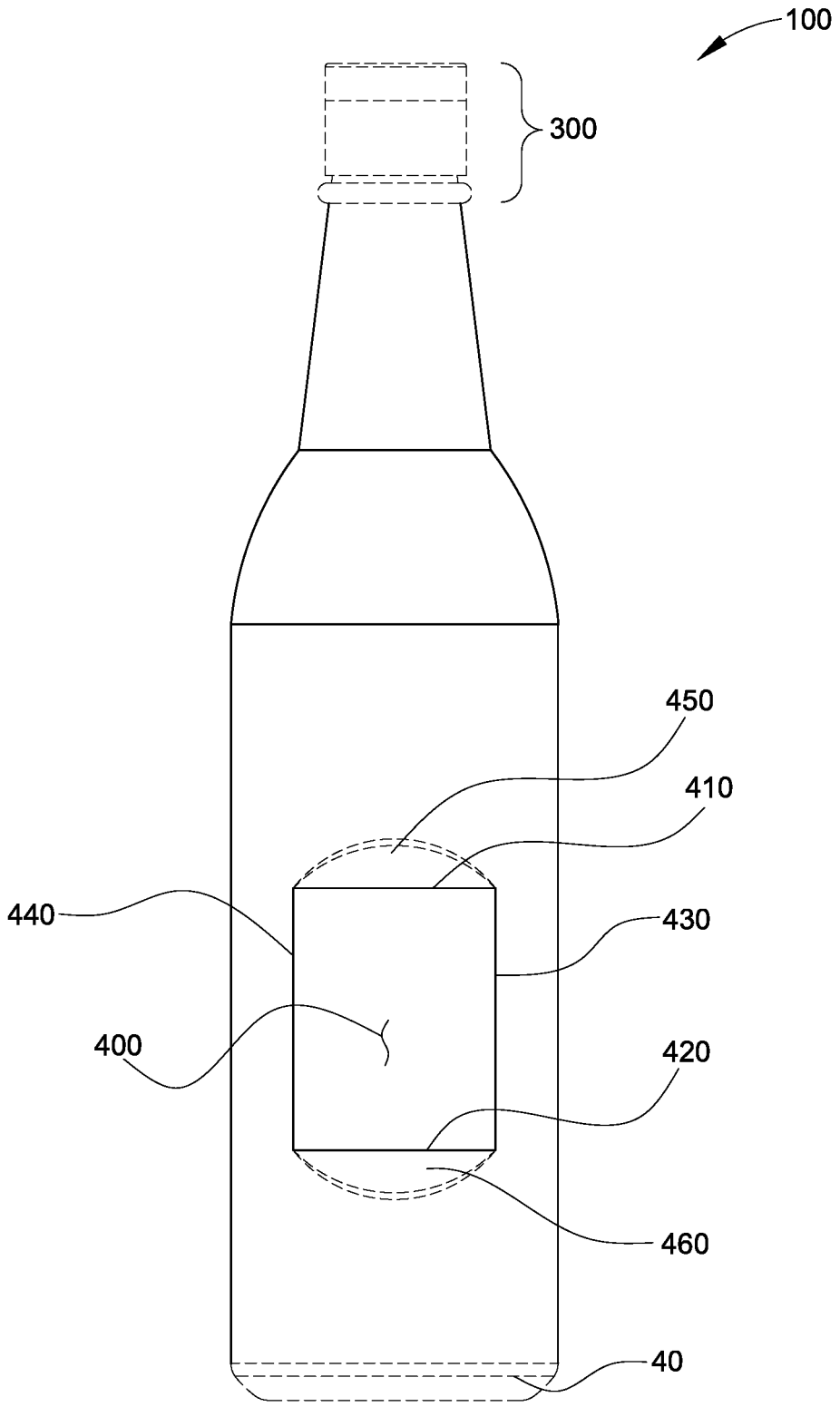
FIG. 4 is a rear view of the bottle-shaped container.

FIG. 2 illustrates a side view of the bottle-shaped container, in accordance with one aspect of the present invention. The bottle shaped container comprises a first recess 200 and a second recess 400. The recess 400 is substantially rectangular, bounded by linear features 410, 420, 430, and 440, as shown in FIG. 4. The shape of the recess 400 includes but is not limited to being rectangular, circular, oval, and other polygons. In the longitudinal direction, the lead-ins 450, 460 to the recess 400 are preferably sloped. While the lead-ins can be substantially perpendicular to a surface of the recess 400 the sloped lead-ins provide easier manufacture. The recess 200 has a length L. The recess 400 has a length of about L/2. It should be noted that other relationships between the recesses are possible including L/3, L/4, and the like.

According to one aspect of the present invention, the longitudinal centers of recess 200 and 400 are aligned.

According to one aspect of the present invention, a longitudinal center of the body portion 30 is aligned with the centers of the recesses 200, 400.

Figure 3:
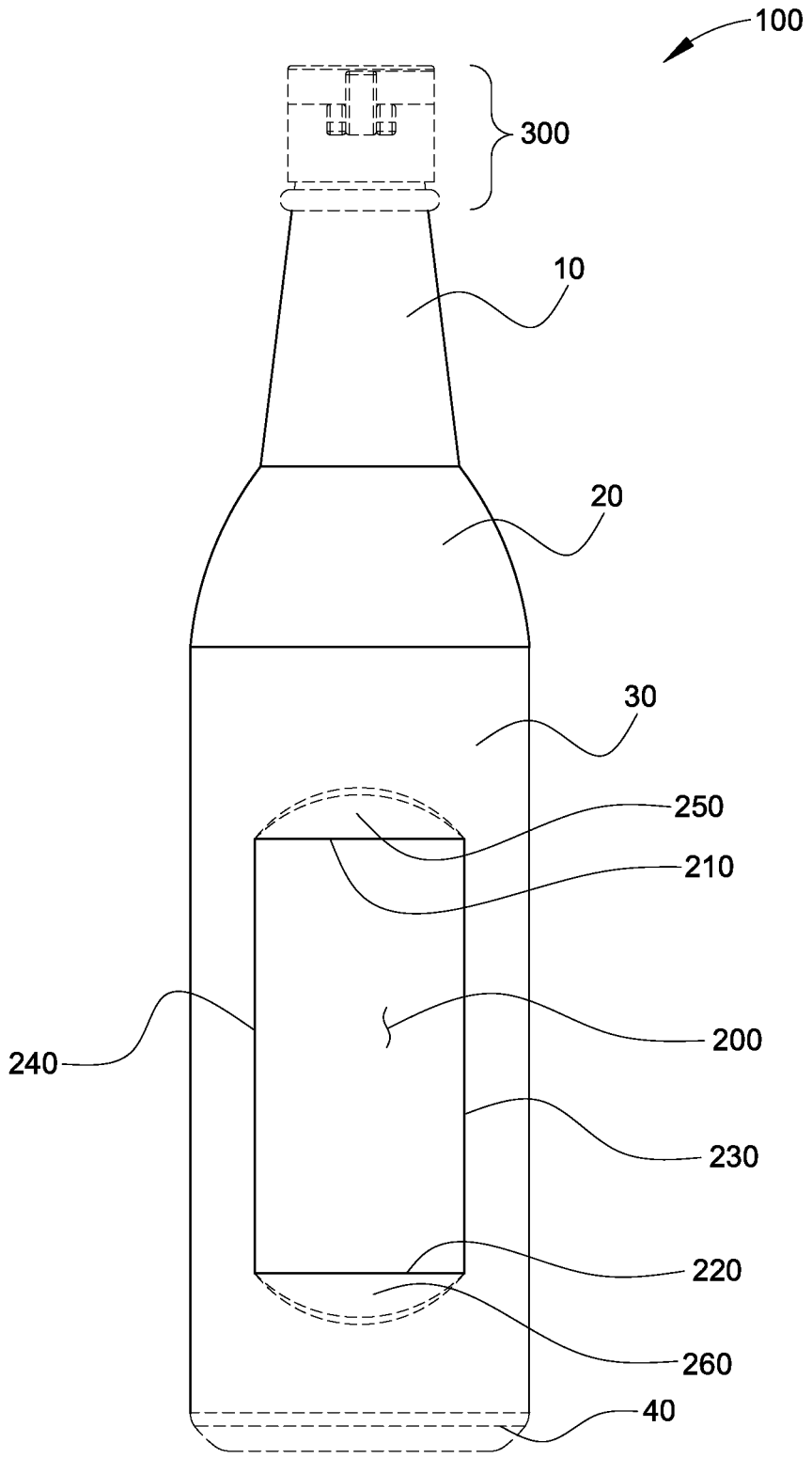
FIG. 3 is a front view of the bottle-shaped container.

FIG. 3 and FIG. 4 respectively illustrate a front view and a rear view of the bottle-shaped container. While shown as rectangular areas other shapes are conceivable. Additionally, an undulating surface is can be provided for the recesses 200, 400 configured to be finger shaped to accommodate the fingers of a user hand. Alternatively, or additionally, the recesses 200, 400 are textured to enhance grip.

Figure 5:
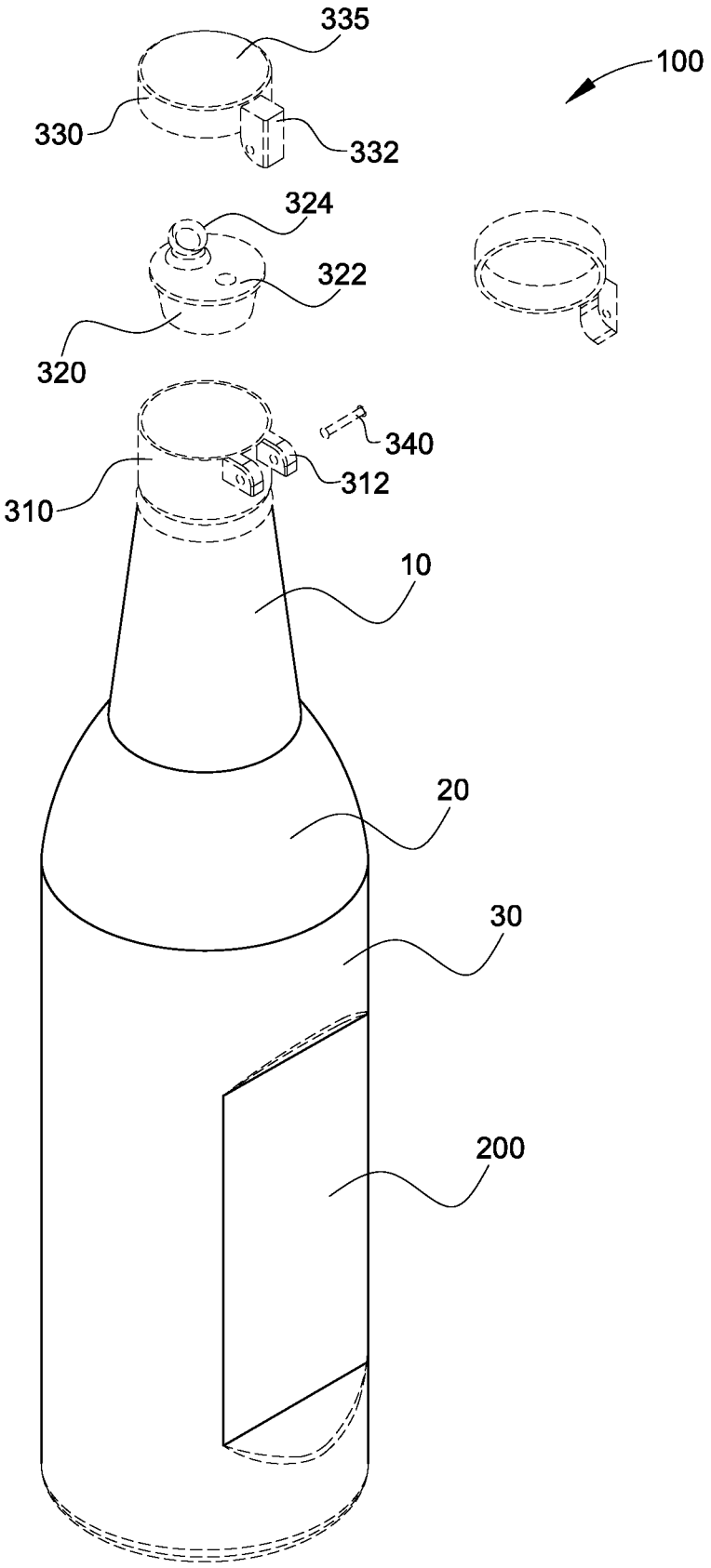
FIG. 5 is an exploded view of the bottle-shaped container.

FIG. 5 illustrates an exploded view of the bottle-shaped container, in accordance with According to one aspect of the present invention. The cap 300, in one embodiment, is a pour cap typically used for but not limited to hot sauce, soy sauce, or the like. The cap 300 includes a base 310 configured to mate with the neck 10 of the bottle 100. The base 310 preferably includes a hinge 312 for a flip top 330. Alternatively, the base 310 and/or top 330 can be a screw top such that only a single component is required. The cap 300 includes an insert 320 that is generally configured to be arranged radially inside the neck 10 and/or base 310.

According to one aspect of the present invention, the insert 320 is a friction fit. The insert 320 includes a pour spout 324 and an optional air hole 322 to assist in smooth pouring. The optional air hole 322 is present based at least in part on the material to be poured.

According to one aspect of the present invention, the top 300 includes a flip top 330 that has a sealing top 335. The sealing top 335 has sealing elements configured to seal the pour spout 324 and optional air hole 322. The top 300 also includes a hinge portion 332 configured to mate with the hinge 312. The two portions are held together with a pin 340. Alternatively, the top 300 can be molded as a single piece.

According to one aspect of the present invention, the bottle, more specifically the neck 10 is keyed as is the cap 300. The corresponding keying ensures a specific orientation between the pour spout 324 of the cap 300, the first recess 200 and the second recess 400. Preferably, the pour spout 324 is closer to the longitudinal center of the second recess 400 than the longitudinal center of the first recess 200.

According to one aspect of the present invention, the cross sectional shape of the body 30, as well as other portions of the body, includes but is not limited to oval, round, square, rectangular, or other polygonal shape. The recesses are describes as being arranged on the body portion 30. However, the recesses can be arranged on the neck 10 or transition 20 if such a transition is present.

According to one aspect of the present invention, in addition to soy sauce and hot sauce, and food service dispensers in general, the bottle shaped container can also be used for beer and wine bottles, and/or any alcoholic/non-alcoholic beverages, oil, or other liquid.

As mentioned, there remains the foregoing description of the specific embodiments that will fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A bottle-shaped container comprising:

a neck portion;

a body portion; and a base, wherein, the body portion has a first recess having a first longitudinal length and a second recess having a second longitudinal length, wherein, a center of the first longitudinal length is aligned with a center of the second longitudinal length at a same axial position such that a distance from the base to the center of the first longitudinal length and the center of the second longitudinal length are equal, wherein the first longitudinal length is different than the second longitudinal length, wherein each longitudinal end of the first recess is axially offset from each longitudinal end of the second recess by a predetermined amount.

2. The bottle-shaped container as claimed in claim 1, wherein the first recess and the second recess are symmetrically positioned in the body portion.

3. The bottle-shaped container as claimed in claim 2, wherein the second longitudinal length is half of the first longitudinal length.

4. The bottle-shaped container as claimed in claim 2, wherein the second longitudinal length is one third of the first longitudinal length.

5. The bottle-shaped container as claimed in claim 2, wherein the second longitudinal length is one quarter of the first longitudinal length.

6. The bottle-shaped container as claimed in claim 2, wherein a longitudinal center of the body portion is aligned with the center of the first longitudinal length and the center of the second longitudinal length.

7. The bottle-shaped container as claimed in claim 1, further comprising a pour spout that is arranged closer to the longitudinal center of the second recess than the longitudinal center of the first recess.

8. The bottle-shaped container as claimed in claim 1, wherein the bottle-shaped container is one of glass and plastic.

9. The bottle-shaped container as claimed in claim 1, wherein the pour spout offset from an axis of the bottle is arranged closer to the longitudinal center of the second recess than the longitudinal center of the first recess.

10. The bottle-shaped container as claimed in claim 1, wherein the first recess and the second recess are rectangular.

11. The bottle-shaped container as claimed in claim 1, wherein the first recess and the second recess are planar.

12. The bottle-shaped container as claimed in claim 1, wherein the first recess is arranged opposite the second recess in the body portion.

13. A bottle-shaped container, comprising:

a neck portion; and a body portion having:

a front wall;

a back wall; and side walls, wherein each side wall has a respective recess, the respective recesses of the side walls together defining a side grip to allow a user to grasp the bottle-shaped container from the side walls, and wherein each recess is longitudinally centered on the body portion, wherein a center of each recess is aligned at a same axial position of the body portion such that a distance from a base of the body portion to the center of each recess is equal, wherein respective longitudinal ends of each recess are axially offset from one another by a predetermined amount.

14. The bottle-shaped container as claimed in claim 13, wherein one side wall recess is configured for corresponding side wall recess at least four fingers to grip and is double a size of a corresponding side wall recess, which is configured for a thumb and enables grasping the bottle-shaped container in a specific way in which a shape of the bottle-shaped container lends itself.

15. The bottle-shaped container as claimed in claim 13, wherein the recesses of the side walls are oppositely positioned from each other.

16. The bottle-shaped container as claimed in claim 13, wherein the recesses of the side walls are symmetrically positioned.

17. The bottle-shaped container as claimed in claim 13, wherein the respective recesses of the side walls comprises a first recess and a second recess, and wherein the second recess is half a size of the first recess.

18. The bottle-shaped container as claimed in claim 13, wherein the bottle-shaped container has a portion having two side walls, each side wall of the portion having different-sized recesses, the recesses of the side walls together defining a side grip to allow a user to grasp the bottle-shaped container from the side walls with fingers that correspond to the recesses.

* * * * *